United States Patent [19]

Butler

[11] Patent Number: 4,664,206

[45] Date of Patent: May 12, 1987

[54] STABILIZER FOR DRILLSTEMS

[75] Inventor: Stuart D. Butler, Calgary, Canada

[73] Assignee: Gulf Canada Corporation, Calgary, Canada

[21] Appl. No.: 779,359

[22] Filed: Sep. 23, 1985

[51] Int. Cl.[4] ..... E21B 17/10

[52] U.S. Cl. ..... 175/325

[58] Field of Search .. ..... 175/323, 325; 308/4 A; 166/241

[56] References Cited

U.S. PATENT DOCUMENTS

| | | | |
|---|---|---|---|
| 4,275,935 | 6/1981 | Thompson et al. | 308/4 |
| 4,438,822 | 3/1984 | Russell | 175/325 |
| 4,456,080 | 6/1984 | Holbert | 175/61 |
| 4,465,146 | 8/1984 | Fitch | 175/325 |
| 4,465,222 | 8/1984 | Hester | 228/170 |

FOREIGN PATENT DOCUMENTS

| | | | |
|---|---|---|---|
| 2517613 | 11/1975 | Fed. Rep. of Germany | 175/325 |
| 0968309 | 12/1980 | U.S.S.R. | 175/325 |

OTHER PUBLICATIONS

N. L. Hycalog, Integral Blade Stabilizers, May 1, 1979.
Drilco, Drilco Stabilizers, May 1, 1979.

*Primary Examiner*—Stephen J. Novosad
*Assistant Examiner*—William P. Neuder
*Attorney, Agent, or Firm*—Bert J. Lewen; Henry Sternberg

[57] ABSTRACT

An improved stabilizer for use in stabilizing both drill collars and other sections on a drill string is disclosed. The stabilizer has at least three circumferentially spaced helical blades which have a tapered portion at each end and a cylindrical portion therebetween, each blade overlapping the adjacent blade within each tapered portion as well as within the cylindrical portion.

10 Claims, 3 Drawing Figures

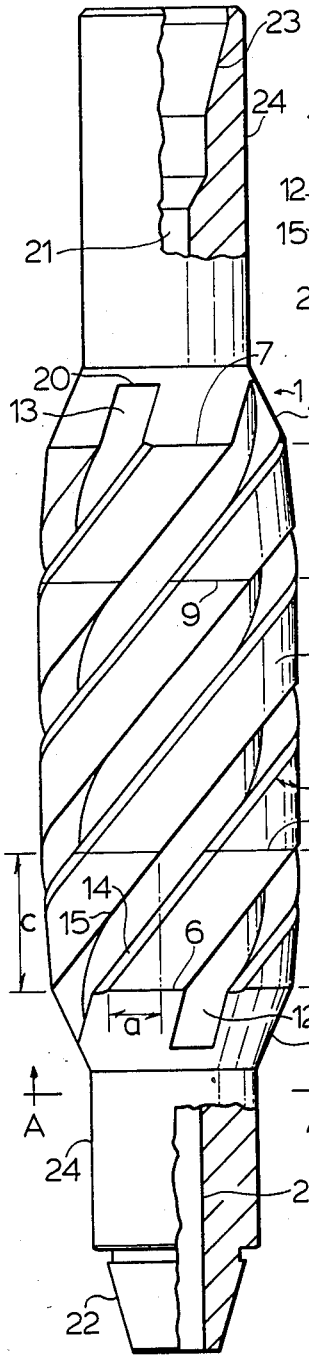
FIG.1.
FIG.2.
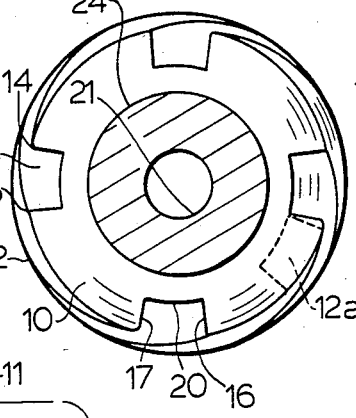
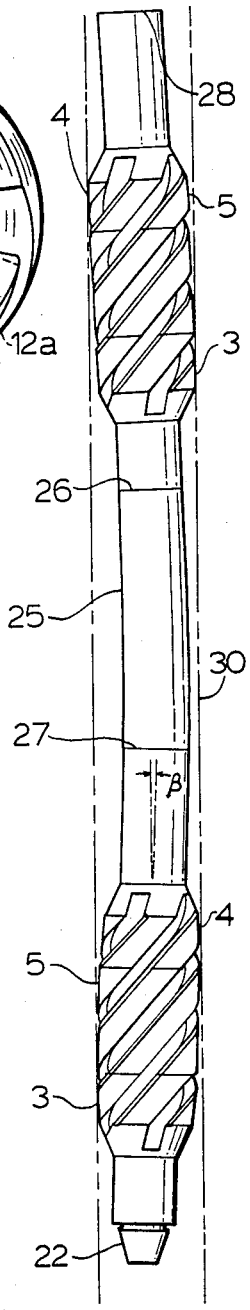
FIG.3.

STABILIZER FOR DRILLSTEMS

This invention relates to stabilizer apparatus for use in well drilling operations. More particularly, it relates to an improved stabilizer for use in stabilizing both drill collars and other sections on a drill string.

It is well known in oil well drilling operations to use drill collar stabilizers for centering a drill string and drill bit. Drill stem stabilizers located at points spaced along a drill collar string guide the direction of drilling by control of the severity and relative position of drill collar deflection. These deflections determine the direction and magnitude of non-axial forces at the drill bit.

Stabilizers having longitudinally extending fins or blades have long been known in the art of well drilling. More recently, helical stabilizers have been developed which improve the uniformity of support afforded by the stabilizer as it rotates. Examples of helical stabilizers have been shown by Owen in U.S. Pat. No. 3,318,398, by Richey in U.S. Pat. No. 4,131,167; by Manuel in U.S. Pat. No. 4,245,709; by Thompson et al. in U.S. Pat. No. 4,275,935; by Russell in U.S. Pat. No. 4,438,822; and by Hester in U.S. Pat. No. 4,465,222. When such stabilizers are acted on by downhole forces, opposite ends of the stabilizer come into contact with the inside surface of the wellbore and generate reactive forces limiting further deflection. Contact of the stabilizer with the wellbore occurs over a small area at the extreme ends of the stabilizer blades, and consequently accelerated blade wear and increased wellbore damage are encountered at those contact areas. In U.S. Pat. No. 4,456,090, Holbert has disclosed a stabilizer having helical blades arranged at equally spaced circumferential intervals such that the upper end of each blade overlaps the lower end of each next successive blade; the blades also have a slight downward taper to minimize any tendency of the stabilizer to cut or ream into the formation. There remains a need in the art for a stabilizer with the ability to maintain a drill stem centred in the wellbore, to minimize driving torque, wellbore damage and wear on the stabilizer blades.

The present invention addresses these problems by providing a drill stem stabilizer comprising at least three circumferentially spaced helical stabilizing blades each having leading and trailing ends, each pair of adjacent blades defining a groove therebetween, a tapered blade portion at each leading and trailing end sufficiently long a bear a transverse load, said leading tapered blade portion and said trailing tapered blade portion being separated by a cylindrical blade portion of a length at least one-half the overall diameter of said stabilizer including said blades, wherein each of said blades overlaps an adjacent blade within said each of tapered portions.

The invention will now be further described with reference to drawings illustrating preferred embodiments of the invention, in which:

FIG. 1 illustrates an elevation in partial section of a preferred stabilizer according to the invention, and FIG. 2 depicts a section of the stabilizer of FIG. 1 along the lines A—A, and FIG. 3 shows a section of wellbore containing a deflected drillstring and two stabilizers according to the invention.

As noted above, the stabilizer of the invention provides blades that are helical in shape and are circumferentially spaced around the core of the stabilizer tool.

The spaces between the blades define grooves which permit the passage of drilling fluids past the stabilizer during well drilling operations. Referring to FIG. 1 by way of example, stabilizer tool 1 has blades 2 disposed in three sections along its longitudinal axis. In the central section 5, between leading intermediate shoulder 8 and trailing intermediate shoulder 9, blades 2 are of constant height to form a generally cylindrical outer surface area. At either end of the central cylindrical section 5 beginning at leading and trailing intermediate shoulders 8 and 9 respectively, the blades have tapered leading and trailing flanks 3 and 4 respectively. It is on these leading and trailing flanks 3 and 4 that the stabilizer tool 1 comes into contact with the wellbore and thereby performs its functions of retaining the drill string (not shown) in a central position in the wellbore and of resisting further deflection. Leading end 10 and trailing end 11 of the stabilizer tool 1 are bevelled for ease of running in the wellbore, as is known in the art. Leading shoulder 6, trailing shoulder 7, and intermediate shoulders 8, 9 are preferably rounded for the same purpose. Stabilizer tool 1 can be fixed on a shaft 24 in a convenient manner or alternatively can be made unitary with shaft 24, said shaft having a bore 21 as is known in the art for the passage of drilling fluids. Threaded end 22 and threaded counter bore 23 are adapted for removably attaching stabilizer tool 1 to a drill string in the conventional manner.

Referring to FIG. 2 in combination with FIG. 1, the sectional end view which shows shaft 24 and bore 21 also shows grooves 12 with greater clarity. Although the figures show four grooves 12 and four blades 2, the invention is adaptable to any convenient number of blades and grooves from 3 to at least 7. It will be seen that sides 16 and 17 of groove 12 provide a cross-section that tapers toward bottom 20 of groove 12, thus promoting self-cleaning of groove 12. Leading blade edge 14 of blade 2 is preferably rounded to minimize reaming of the wellbore and to minimize the concomitant torque requirements for turning the drill stem. Trailing blade edge 15 can conveniently be square if desired. Preferably outside corners are radiussed and inside corners filleted as is known in the art. The total cross-sectional area of grooves 12 is selected to allow appropriate flow velocities of drilling fluid past stabilizer tool 1 in the wellbore. It will be remembered that as stabilizer tool 1 rotates in the wellbore, grooves 12 will exert a certain amount of pumping action which will aid the flow of drilling liquids upwards past stabilizer tool 1. The width of blades 2 can be seen at leading end 10 in FIG. 2; the width of blades 2, measured at the perimeter of stabilizer tool 1, is at least equal to the width of grooves 12, in order to provide appropriate surface to carry the frictional forces inherent in the stabilizing action. Stabilizer tool 1 can be manufactured from any suitable abrasion resistant material, for example stainless steel, hardened steel or non-magnetic metals. Suitable abrasion resistant facings can be superimposed on stabilizer tool 1 at appropriate locations, for example at leading blade edge 14.

It is critical that blade helix angle $\alpha$ and the length of leading blade sections 3 a portion of any blade at leading shoulder 6 is aligned with respect to the longitudinal axis with a portion of an adjacent blade at leading intermediate shouler 8 to provide 100% contact of blade surface against the wellbore in leading tapered blade section 3. The overlap is shown in FIG. 1 as dimension "a". Because helix angle $\alpha$ is conveniently maintained constant throughout the length of stabilizer tool 1, trailing tapered blade section 4 can conveniently be of the same length as leading tapered blade section 3 and will necessarily have the same blade surface overlap between trailing intermediate shoulder 9 and trailing shoulder 7 as just described with respect to leading tapered blade section 3. It is preferable that no groove 12*a* at trailing shoulder 7 should be at a 180° remote circumferential position to any groove at leading shoulder 6. This provision aids further in reducing interference with the wellbore and consequently torque required to drive the drill string, and will be discussed below with respect to wrap angle.

FIG. 3 depicts two stabilizer tools of the invention in operation on a drillstring. Wellbore 30 is shown as straight but may be curved in at least a portion of its length. Stabilizer tools 1 are fixed in a portion of drillstring 25 at joints 26 and 27. Further portions of drillstring (not shown) are attached at joint 28 and at thread 22. Drillstring portion 25 is shown with a bend exaggerated for clarity. It will be seen that leading flanks 3 and trailing flanks 4 of the two stabilizer tools 1 are in contact with wellbore 30. The force of said contact prevents deflection of drillstring adjacent stabilizer tools 1 beyond a certain amount which is dependent upon the length of the stabilizer tools 1 and the difference between the diameters of wellbore 30 and stabilizer tool 1. This difference, usually called the clearance, is usually from about 0.5 percent to 2 percent of the diameter of wellbore 30. The length of the central cylindrical portion 5 of stabilizer tool 1 is at least one-half, preferably at least equal to, the inside diameter of wellbore 30, in order to control the deflection angle $\beta$ without requiring excessively tight clearance between stabilizer tool 5 and wellbore 30. The length of each of the leading flank 3 and trailing flank 4 must be at least about one-third and preferably at least one-half of the diameter of wellbore 30, thus spreading the anti-deflection and frictional forces over a significant length of stabilizer blades and having the effect of minimizing wear on the stabilizer tool 1 and also minimizing reaming of the wellbore 30. The width of any groove should be no greater than about one-third of the nominal wellbore diameter, to minimize erratic movement of the stabilizer tool 1 as it rotates within the wellbore 30.

Within the aforementioned criteria, the person skilled in the art can calculate the dimensions of a stabilizer tool for manufacturing purposes. For examples, where the nominal wellbore diameter is 444.5 nm and the desired stabilizer tool clearance is 6.4 mm, the person skilled in the art will know the required rate of drilling fluid circulation and will size the total groove flow area accordingly. It is known in the art that in a 444.5 mm diameter wellbore, the circulating area is preferably at least about 380 $cm^2$; thus with a selected groove depth and a number of blades, the dimensions of each groove can be calculated. In a stabilizer of 438.1 mm diameter, for example, five blades of 152.4 mm width, the grooves being 122.9 mm wide and 75 mm deep, measured perpendicular to the longitudinal axis of the stabilizer tool, will give a circulating area, of 473 $cm^2$. Combining the calculated groove and blade width with a flank length (dimension "c" in FIG. 1) of 139.7 mm, the minimum helix angle $\alpha$ of blades 2 that will allow overlap of blades within each flank is calculated to be 48.7 degrees. In contrast the largest angle known to be used in the prior art is about 30°. Thus the pitch of the blades will be $$\frac{\text{(diameter of tool)} \times \text{pi}}{\tan\text{(helix angle)}} = \frac{438.1 \times \text{pi}}{\tan 48.7^\circ},$$

or 1210 mm, in the present example. The wrap angle of such blades around the circumference of the exemplified stabilizer tool 914.4 mm long will be 272°. Thus groove 12 at the leading end of stabilizer tool 1 (FIG. 2) will be 272° displaced around the axis and will be in position 12*a* at the trailing end of the stabilizer tool 1. To ensure optimum performance, the circumferential position of the trailing end grooves should be diametrically opposite the circumferential position of the blades on the leading end of the tool. This can be achieved by an increase in the helix angle $\alpha$. In this example the helix angle $\alpha$ would be increased from 48.67° to 50.2° and the final pitch would be 1143 mm.

Referring again to FIG. 1, it will be noted that tapered flanks 3 and 4 are shown as frustoconical in shape, the larger ends of the cones being the leading and trailing intermediate shoulders 8 and 9 and the smaller ends being the leading and trailing shoulders 6 and 7. Alternatively the outer surface of the tapered flanks can be rounded, such that the rounded portion extends from the leading and trailing intermediate shoulders 8 and 9 to the leading and trailing shoulders 6 and 7 respectively and is arcuate in outline. While the frustoconical flanks of one preferred embodiment offer a highly conforming contact with the wellbore 30 when the clearance is at design tolerances, the rounded flanks of the second preferred embodiment are adaptable to a greater range of wellbore-to-stabilizer clearances. Both preferred embodiments accomplish the objectives of the invention, and other embodiments can be readily devised from this disclosure which, while not specifically described, will be within the scope of the appended claims.

What is claimed is:

1. A drillstem stabilizer comprising:

(a) at least three circumferentially spaced helical stabilizing blades each having leading and trailing ends, each pair of adjacent blades defining a groove therebetween, (b) a tapered blade portion at each leading and trailing end sufficiently long to bear a transverse load, said leading tapered blade portion and trailing tapered blade portion being separated by a cylindrical blade portion of a length at least one-half the overall diameter of said stabilizer including said blades, wherein at least a portion of each of said blades is aligned with at least a portion of an adjacent blade with respect to the longitudinal axis of the stabilizer within each of said tapered portions.

2. A stabilizer as claimed in claim 1, wherein said tapered portions are substantially frustoconical.

3. A stabilizer as claimed in claim 2, wherein the cone angle of said frustoconical tapered portions is adapted to spread said transverse load along the length of each tapered portion.

4. A stabilizer as claimed in claim 1, wherein said tapered portions are arcuate in outline.

5. A stabilizer as claimed in claim 1, wherein the angular position of each of said grooves at one end of said stabilizer is displaced substantially 180° from the circumferential position of a blade at the opposite end of said stabilizer.

6. A stabilizer as claimed in claim 1, wherein the width of said blades at the outside diameter thereof is at least equal to the width of grooves between said blades.

7. A stabilizer as claimed in claim 1, having at least three and no more than seven blades.

8. A stabilizer as claimed in claim 1 wherein said tapered blade portions are of equal length.

9. A stabilizer as claimed in claim 4 wherein each of said tapered blade portions is at least one-third as long as said cylindrical blade portion.

10. A stabilizer as claimed in claim 1 wherein the width of each groove at the base of said blades is less than the width of said groove at the peripheral surface of said blades.

* * * * *